US009838793B2

(12) United States Patent
Millar et al.

(10) Patent No.: US 9,838,793 B2
(45) Date of Patent: Dec. 5, 2017

(54) SUSPENSION ELEMENT FOR SUSPENDING THE DIAPHRAGM OF A LOUDSPEAKER DRIVER TO THE CHASSIS THEREOF AS WELL AS DRIVER AND LOUDSPEAKER COMPRISING THE SAME

(71) Applicant: Genelec Oy, Lisalmi (FI)

(72) Inventors: Stephen Millar, Iisalmi (FI); Jaakko Nisula, Iisalmi (FI); Jussi Väisänen, Iisalmi (FI); Ilpo Martikainen, Iisalmi (FI)

(73) Assignee: Genelec Oy, Iisalmi (FI)

( * ) Notice: Subject to any disclaimer, the term of this patent is extended or adjusted under 35 U.S.C. 154(b) by 0 days.

(21) Appl. No.: 14/898,104

(22) PCT Filed: Jun. 14, 2013

(86) PCT No.: PCT/FI2013/050653

§ 371 (c)(1),
(2) Date: Dec. 11, 2015

(87) PCT Pub. No.: WO2014/199000

PCT Pub. Date: Dec. 18, 2014

(65) Prior Publication Data

US 2016/0142825 A1 May 19, 2016

(51) Int. Cl.
*H04R 7/20* (2006.01)

(52) U.S. Cl.
CPC ..... *H04R 7/20* (2013.01); *H04R 2307/204* (2013.01); *H04R 2307/207* (2013.01)

(58) Field of Classification Search
CPC ... H04R 7/20; H04R 7/16; H04R 1/06; H04R 9/04; H04R 9/06; G06F 1/18
(Continued)

(56) References Cited

U.S. PATENT DOCUMENTS 2,302,178 A 11/1942 Brennan
4,327,257 A * 4/1982 Schwartz ..... H04R 9/022 181/171
(Continued)

FOREIGN PATENT DOCUMENTS

JP H05 316590 A 11/1993
JP H05316590 A 11/1993
(Continued)

OTHER PUBLICATIONS

World Intellectual Property Office, International Search Report issued in application No. PCT/FI2013/050653, dated Mar. 17, 2014, European Patent Office, the Netherlands.
(Continued)

*Primary Examiner* — Gerald Gauthier
(74) *Attorney, Agent, or Firm* — Chernoff, Vilhauer, McClung & Stenzel, LLP

(57) ABSTRACT

The present invention provides a loudspeaker driver not suffering from high levels of distortion caused by the non-linear stiffness commonly found with drivers that utilize progressive suspension elements. The novel suspension element for suspending the diaphragm of a loudspeaker driver to the chassis thereof has a geometry with two opposing first sections and two opposing second sections, which connect the two first sections. The second sections have a curvature radius smaller than that of the first sections. The mean height of the radial cross-sectional profile of the second section is higher than the height of the cross-sectional profile of the first sections. The first sections have an axial stiffness greater than the second sections.

20 Claims, 9 Drawing Sheets

(58) Field of Classification Search
USPC ..... 181/171, 173, 169; 381/152, 396, 398, 381/400, 423, 426, 74, 184, 405, 418; 210/321.73; 257/690; 385/12
See application file for complete search history.

(56) References Cited

U.S. PATENT DOCUMENTS

| | | | | | |
|---|---|---|---|---|---|
| 4,433,214 | A * | 2/1984 | Jasinski | H04R 7/20 | 181/172 |
| 5,216,723 | A * | 6/1993 | Froeschle | H04R 3/002 | 381/415 |
| 5,450,499 | A * | 9/1995 | Morris, Sr. | H04R 1/02 | 381/338 |
| 5,847,333 | A * | 12/1998 | D'Hoogh | H04R 7/20 | 181/156 |
| 5,937,075 | A * | 8/1999 | Goller | H04R 7/02 | 181/171 |
| 6,445,803 | B1 * | 9/2002 | Boon | H04R 9/06 | 381/184 |
| 6,920,957 | B2 * | 7/2005 | Usuki | H04R 9/06 | 181/166 |
| 7,275,620 | B1 | 10/2007 | Diedrich | | |
| 8,397,861 | B1 * | 3/2013 | Xu | H04R 7/18 | 181/171 |
| 9,363,593 | B2 * | 6/2016 | Kawka | H04R 1/06 | |
| 9,538,290 | B2 * | 1/2017 | Papp | H04R 1/24 | |
| 9,538,292 | B1 * | 1/2017 | Boyd | H04R 9/04 | |
| 9,681,233 | B2 * | 6/2017 | Little | H04R 7/16 | |
| 9,693,146 | B2 * | 6/2017 | Little | H04R 9/06 | |
| 2002/0146145 | A1 * | 10/2002 | James | H04R 9/046 | 381/426 |
| 2004/0218778 | A1 * | 11/2004 | Weisman | H04R 9/041 | 381/396 |
| 2005/0147272 | A1 * | 7/2005 | Hyre | H04R 9/06 | 381/398 |
| 2005/0201588 | A1 * | 9/2005 | Funahashi | H04R 7/26 | 381/423 |
| 2007/0116304 | A1 * | 5/2007 | Hall | H04R 1/025 | 381/152 |
| 2008/0212822 | A1 | 9/2008 | Basnet et al. | | |
| 2009/0290748 | A1 * | 11/2009 | Kam | H04R 9/043 | 381/398 |
| 2011/0164782 | A1 | 7/2011 | Bogdanov et al. | | |
| 2011/0243364 | A1 * | 10/2011 | Walter | H04R 9/025 | 381/397 |
| 2011/0243365 | A1 * | 10/2011 | Carlmark | H04R 11/02 | 381/398 |
| 2011/0243366 | A1 * | 10/2011 | Carlmark | H04R 11/02 | 381/398 |
| 2011/0299716 | A1 * | 12/2011 | Reckert | H04R 7/02 | 381/398 |
| 2012/0177244 | A1 * | 7/2012 | Liu | H04R 7/18 | 381/396 |
| 2013/0003984 | A1 * | 1/2013 | Belafonte | H04R 1/2811 | 381/74 |
| 2013/0142379 | A1 * | 6/2013 | Varla | H04R 9/04 | 381/400 |
| 2014/0056463 | A1 * | 2/2014 | Kim | H04R 9/043 | 381/398 |
| 2014/0270328 | A1 * | 9/2014 | Lucas | H04R 9/027 | 381/400 |
| 2015/0312679 | A1 * | 10/2015 | Little | H04R 9/06 | 381/398 |
| 2016/0142825 | A1 * | 5/2016 | Millar | H04R 7/20 | 381/398 |

FOREIGN PATENT DOCUMENTS

| | | | |
|---|---|---|---|
| JP | H0746690 | A | 2/1995 |
| JP | H07046690 | A | 2/1995 |
| JP | H08079885 | A | 3/1996 |
| JP | H10257590 | A | 9/1998 |
| JP | H11146488 | A | 5/1999 |
| JP | 2006339831 | A | 12/2006 |
| JP | 2007282012 | A | 10/2007 |
| JP | 2009183002 | A | 8/2009 |
| JP | 2010226373 | A | 10/2010 |
| NO | 2004004410 | A | 1/2004 |
| WO | 0131975 | A2 | 5/2001 |

OTHER PUBLICATIONS

Japanese Patent Office; Notice of Reason for Refusal; Office action; dated Apr. 25, 2017; 3 pages; Japan.
Japanese Patent Office; Notice of Reason for Refusal (office action); dated Aug. 1, 2017; 4 pages; Japan.

* cited by examiner

SUSPENSION ELEMENT FOR SUSPENDING THE DIAPHRAGM OF A LOUDSPEAKER DRIVER TO THE CHASSIS THEREOF AS WELL AS DRIVER AND LOUDSPEAKER COMPRISING THE SAME

CROSS-REFERENCE TO RELATED APPLICATIONS

This application is a national stage application filed under 35 U.S.C. §371 based on International Application No. PCT/FI2013/050653 filed Jun. 14, 2013 and claims priority under 35 U.S.C. §119 thereto.

TECHNICAL FIELD

The present invention relates to sound reproduction. In particular, the invention relates to suspending a diaphragm of a loudspeaker driver.

BACKGROUND OF THE INVENTION

Reciprocal drivers used in loudspeakers typically include a chassis, which forms the rigid mechanical framework for the driver, a vibrating diaphragm, which is driven axially by means of electromagnetic induction forces generated by alternating current, and a suspension element surrounding the diaphragm and elastically coupling it to the chassis. It is paramount that the movement of the diaphragm is precisely and accurately controlled, which is a matter of suspension element design. Ideally, the movement of the diaphragm is linear, or in other words, the diaphragm motion in the axial direction is directly proportional to the magnitude of the alternating current that is applied to the driver. If the movement of the diaphragm is non-linear, then the sound becomes distorted.

Generally speaking, the aim is to provide a progressive suspension element with fairly constant stiffness for small displacements, and a rapidly increasing stiffness for large displacements. Thus, an ideal progressive suspension element will add low amounts of non-linearity (distortion) to the motion of the diaphragm for small displacements whilst also protecting the driver from damage during large excursions.

The surrounding suspension element of a loudspeaker driver is easier to design when the shape of the suspension element is essentially round in relation to the direction of movement of the driver diaphragm. In such a configuration, there is axial-symmetry and the force exerted by the suspension element (restoring the diaphragm to its rest position) is usually equal and symmetrical at all locations around the perimeter of the suspension element. Typically, when the shape of the suspension element is essentially round, the cross-sectional profile of the suspension element has the same geometry all the way around the perimeter of the suspension element.

The suspension properties of the suspension element are typically expressed by means of stiffness profile, i.e., a chart that plots the stiffness of the suspension versus the displacement of the diaphragm. For a low distortion driver, the stiffness should be fairly even for small displacements and the stiffness should be fairly symmetrical, i.e., fairly equal stiffness values for positive and negative displacements.

Designing the suspension of the diaphragm becomes more complicated when the geometry of the diaphragm has not only curved sections but also straight sections. More precisely, suspension design is more challenging for diaphragms having straight sections joined together by curves, i.e., a "stadium shape". Such drivers generally suffer from uneven distribution of the forces exerted by the suspension element for restoring the diaphragm to its rest position. The stiffness profiles of such drivers can be very non-linear and the progressive suspension that should prevent over-excursion of the diaphragm to prevent damage is not always functioning as it should. This sort of non-linearity may appear as distortion in the output curve of the loudspeaker.

It is therefore an aim to provide a loudspeaker driver not suffering from high levels of distortion caused by the non-linear stiffness commonly found with drivers that utilize progressive suspension elements.

It is a particular aim of the invention to provide a suspension element for a vibrating diaphragm, which has a geometry featuring two parallel opposing straight sections and two opposing curved sections connecting the two straight sections, and which diaphragm would have a more idealized stiffness profile with a linear (low distortion) diaphragm motion for small displacements and a rapidly increasing stiffness for high displacements to prevent driver damage resulting from over excursion. It is also an aim of the present invention to re-distribute the restoring forces exerted by the suspension element onto the diaphragm in a way that reduces problems caused by standing wave resonance patterns which add unwanted color to the sound. By combining tangential stress relief measures with the re-distribution of the suspension element's restoring forces it is hoped that the linear excursion range can be increased further than conventional speaker designs.

BRIEF SUMMARY OF THE INVENTION

The aforementioned aim is achieved with aid of a novel suspension element for suspending the diaphragm of a loudspeaker driver to the chassis thereof. The novel suspension element has a geometry with two opposing first sections and two opposing second sections, which connect the two first sections. The second sections 110 have a curvature radius smaller than that of the first sections 130. The mean height of the radial cross-sectional profile of the second section is higher than the height of the cross-sectional profile of the first sections. The first sections have an axial stiffness greater than the second sections.

The aforementioned aim is also achieved with a novel driver and loudspeaker featuring such a novel suspension element.

The foregoing and other objectives, features, and advantages of the invention will be more readily understood upon consideration of the following detailed description of the invention taken in conjunction with the accompanying drawings.

Benefits

Considerable benefits are gained with aid of the proposed solution. By virtue of the novel design, the distortion is reduced for small displacements, where the design of the suspension elements achieves quite a linear displacement behavior. On the other hand, the same suspension design provides proper driver protection by generating progressive suspension characteristics for larger displacement outside of the linear displacement range. If principles of tangential stress relief are employed in connection with the novel design, the linear displacement range can be increased further. Tangential stress relief principles are discussed later on in this document.

The novel suspension element has a further surprising advantageous effect. Test runs of the element have revealed that the present design also increases frequencies at which standing wave patterns occur. The standing wave patterns are resonances that color the sound. The upper frequency limit that the driver can be used for sound reproduction without coloration from standing waves in the diaphragm and suspension element is increased.

DETAILED DESCRIPTION

Figure 1:
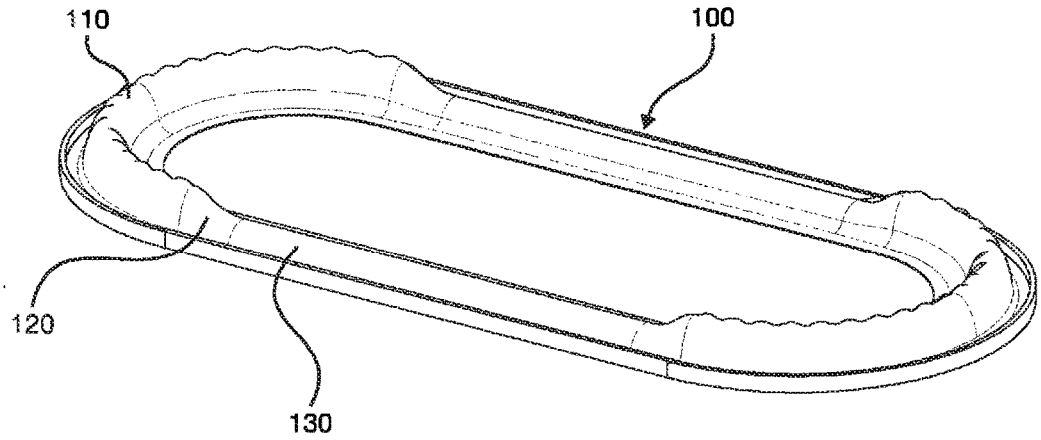
FIG. 1 presents an isometric view of the suspension element according to one embodiment.

The suspension element 100 according to one embodiment includes two opposing first sections 130 which are connected by two opposing second sections 110 for matching to the geometry of the diaphragm 300. The second sections 110 are curved and have a curvature radius smaller than that of the first sections 130. In the embodiment illustrated in FIGS. 1 and 2, the first sections 130 are essentially straight, whereby the curvature radius of said straight first sections 130 is approximately infinite. Upon very close inspection, all straight bodies have a slight curvature, but nevertheless the curved second section 130 is in any case more curved than the first section 130. For the sake of clarity, said first and second sections are in the following referred to as the straight and curved sections 110, 130, respectively.

Indeed, the suspension element 100 includes two parallel opposing straight sections 130 and two opposing non-linear sections 110, which connect the two straight sections 130. The resulting shape resembles that of a stadium or an "oval" racetrack. In the illustrated example, the non-linear sections 110 are curved and have the shape of a semi-circle. The non-linear sections 110 could also have the shape of a plurality of incremental turns or angles, which would add up to an approximated semi-circle. As the present embodiment features curved sections, the non-linear sections shall hereafter be referred to as curved sections for the sake of simplicity. Omitted from FIG. 1 is the chassis and diaphragm, which also have a similar geometry, i.e., "stadium shape". In this context, the term driver or diaphragm shape or geometry refers to geometry of the diaphragm when viewed as an orthographic projection of the driver or diaphragm geometry on to a plane in front of the driver or diaphragm, the plane being normal to the direction of motion of the diaphragm and the driver's other moving parts.

In this context, the term axial direction refers to the direction to which the diaphragm of the driver is configured to move. Respectively, the term radial direction means all directions normal to the axial direction in question. Furthermore, the term forward means the direction in which the diaphragm moves in an outwards direction, away from the inside (air cavity) of the loudspeaker enclosure. Conversely, the term rearward means the opposite of forward direction, namely the direction in which the diaphragm moves inwards, towards the inside of the loudspeaker enclosure. Respectively, the terms front and rear represent the sides of the driver that are in the direction of forward or rearward directions.

Figure 2:
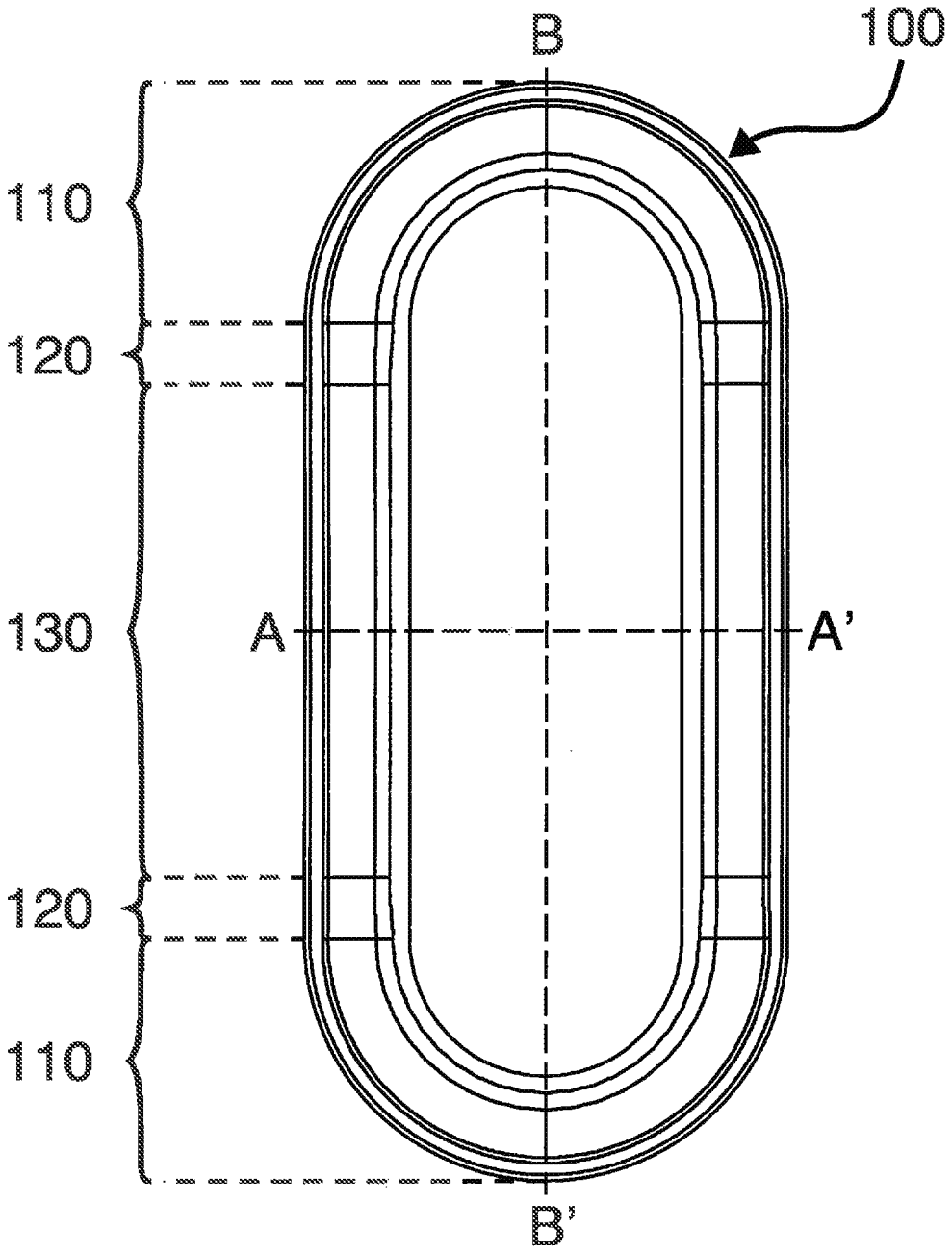
FIG. 2 presents an elevation view of the suspension element of FIG. 1.

As is also apparent from FIGS. 1 and 2, the straight and curved sections 130, 110 are joined together by a transition section 120. The transition sections 120 may be straight, but they may also be curved. The transition sections 120 are in any case shaped to morph from the profile of the straight section 130 to that of the curved section 110. Next, the concept of stiffness and the dimensioning principles of the suspension element are elaborated.

In a simplified sense, stiffness is the derivative of the restoring force exerted by the suspension element with respect to displacement, which is in the field expressed as "δ force/δ displacement". If the restoring force exerted by the suspension element is plotted as a function of displacement, then the gradient of the plotted function at any point on the graph gives the stiffness. More precisely, stiffness of a non-linear elastic suspension element is defined as $d(f)/dx$, where f is the restoring force exerted by the suspension, in Newtons for example, and x is the displacement from the rest position, in meters for example.

To adjust the distribution of the forces exerted by the suspension element and to make the total stiffness of the suspension element more linear, different cross-sectional profiles are used in various locations around the suspension element. For example, the height of the cross-sectional profile—and therefore the free-length of material used in the suspension element roll—can be increased to reduce the restoring forces exerted by the suspension element in that particular area. Conversely, the height of the cross-sectional profile can be reduced to increase the restoring forces exerted by the suspension element in that particular area. It is thus possible to modify the stiffness of the curved sections 110, the straight sections 130 and also the transition sections 120 combining the two to distribute the restoring forces exerted by the suspension element 100 in a way that avoids loading the far ends of the diaphragm 400 excessively. The restoring forces exerted by the suspension element 100 can be re-distributed closer to middle of the driver. This results in reducing problems arising from standing wave patterns, raising the frequencies at which the standing wave resonances occur. This extends the upper frequency performance of a driver.

By utilizing various combinations of stiff straight sections 130 of suspension element 100 combined with less stiff curved suspension element sections, an ideal combination can be found from simulations, which gives a much more even stiffness profile for small displacements. The combination of stiff straight sections 130 and less stiff curved sections 110 also provides a well-functioning progressive stiffness profile that successfully prevents damage to the driver 300 caused by over excursion. The combination of stiff straight sections 130 and less stiff curved sections 110 creates a well-functioning progressive suspension element without the non-linearity's that are commonly found with such progressive suspension elements.

Figure 3:
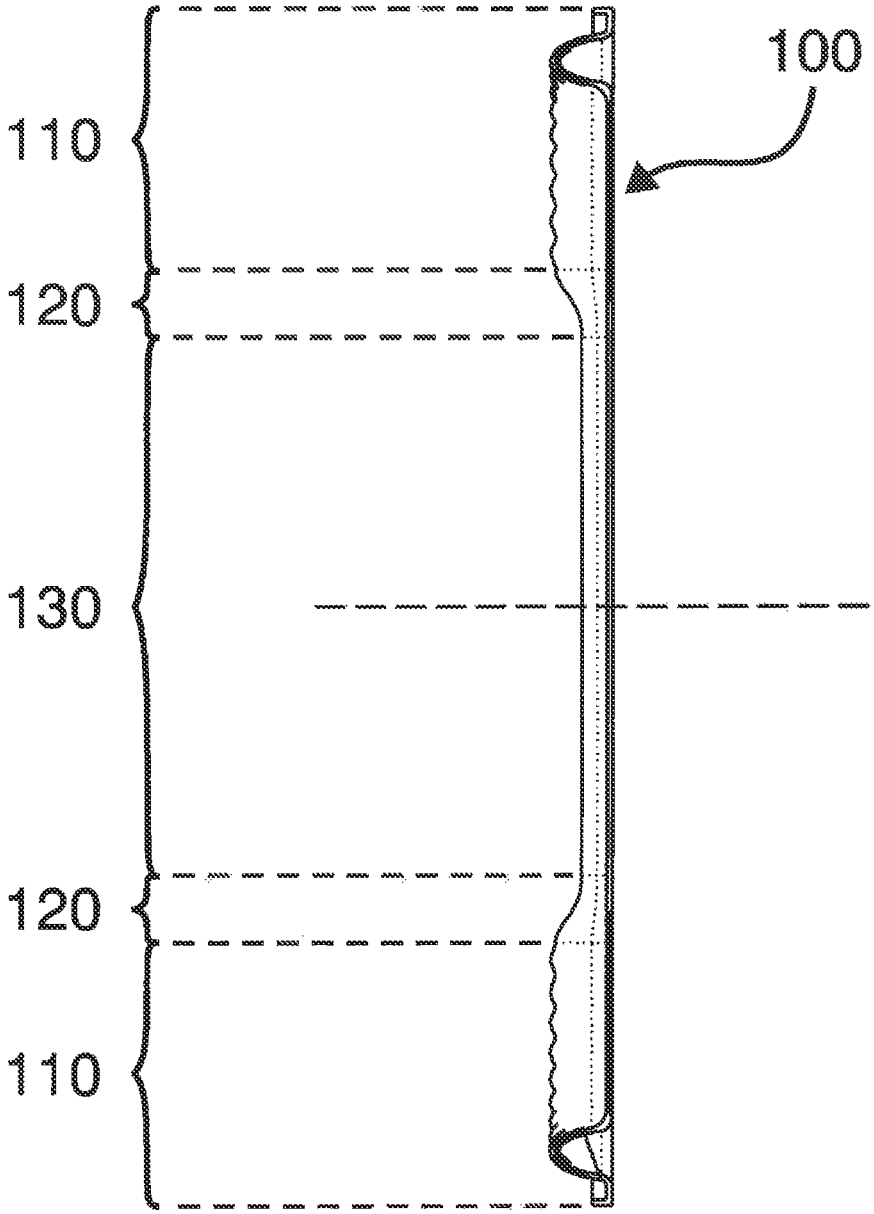
FIG. 3 presents a longitudinal cross-sectional view taken along the line B-B' of the suspension element of FIG. 1.
Figure 4:
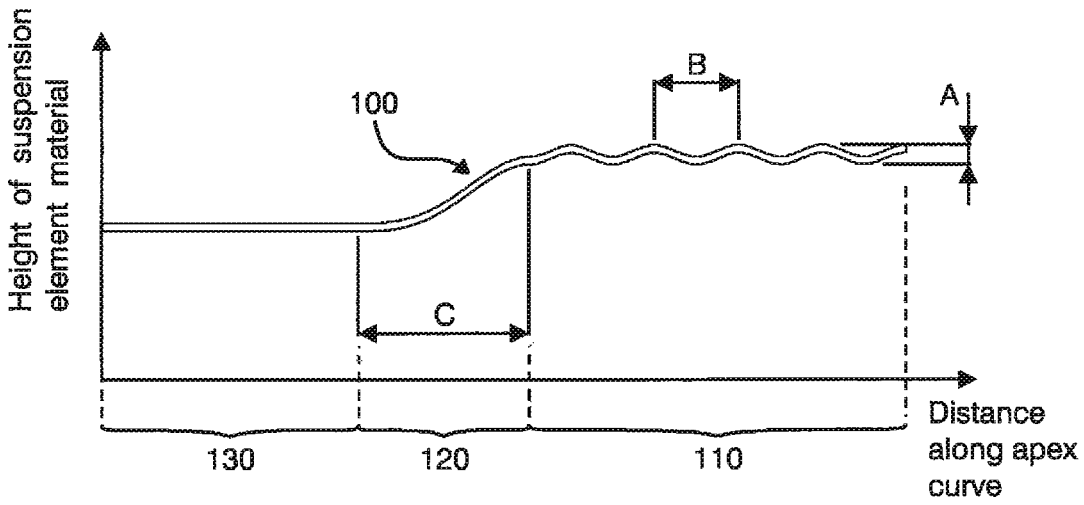
FIG. 4 presents a detail view of the undulation of the curved section and of the transition between the straight section and curved section of FIG. 1.
Figure 5:
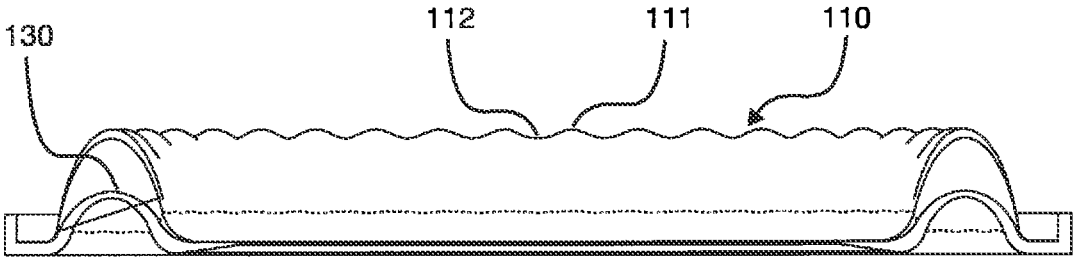
FIG. 5 presents a cross-sectional view taken along the line A-A' of the straight section of the suspension element of FIG. 1.

Turning now to FIGS. 3 to 5, which illustrate these design principles by showing cross-sectional views of the suspension element 100 according to one embodiment.

The height of the cross-sectional profile of the straight section 130 determines the displacement beyond which the progressive nature of the suspension element begins. The "free length" of the suspension element roll is relevant because once the suspension element material un-rolls the stiffness rises sharply. More "free-length" means more displacement before the stiffness rises sharply. The height of the cross-sectional profile of the straight section 130 is tuned carefully using simulations to give the "flattest" stiffness in the linear area of the stiffness profile. Too little height results in the ends of the stiffness profiles rising up in the linear area. Conversely, too much height results in the ends of the stiffness profiles dropping down in the linear area. The length of the straight section 130 determines how much of the restoring forces are focused near middle of the driver. The straight section is the stiffest, and has the highest concentration of force. Keeping this highest concentration of force as close to the axis of the driver as possible reduces the distances of diaphragm 300 and suspension element 100 where standing waves can occur. Shorter distances equal higher frequencies, and a higher upper frequency that the driver can be used without coloration from standing wave patterns.

As may be seen from FIGS. 3 to 5, the curved section 110 of the suspension element 100 is higher than the straight section 130 thereof. Particularly, the mean height of the radial cross-sectional profile of the curved section 110 is higher than the height of the cross-sectional profile of the straight sections 130 when viewed along the circumference of the suspension element 100. The increased height of the cross-sectional profile of curved section 110 lowers the stiffness of the curved areas. The "free length" of the suspension element roll is relevant because more "free-length" generally results in lower stiffness. By using higher cross-sectional profiles in the curved sections 110 compared to the height of the cross-sectional profiles of the straight sections 130, it is possible to reduce the stiffness of the suspension elements in the curved sections. If the same cross-sectional profile was to be used all around the suspension element 100, then the curved sections 110 would actually be much stiffer than the straight sections 130. This is far from ideal, as it is preferable to concentrate the restoring forces closer to the middle of the speaker to reduce the distances of the diaphragm and suspension where the standing waves can occur. Shorter distances equal higher frequencies, and a higher upper frequency that the driver can be used without coloration from standing wave patterns.

The curved sections 110 do not have a flat, linear stiffness profile. Because of this, it is preferable to reduce the effect from the very non-linear curved sections stiffness. Since it is desirable that the total stiffness of the suspension element as a whole provides a linear motion to the diaphragm 300, it is preferred to reduce the stiffness from the non-linear curved sections and also increase the stiffness of the very linear straight sections until the stiffness of the whole suspension element 100 looks as close as possible to the ideal stiffness profile.

The curved section 110 is especially designed to mitigate the effects of a phenomenon known as tangential stress. The suspension element material is stretched when the diaphragm moves in one direction and folded in a tangential direction when the diaphragm moves in the opposite direction. This tangential folding is also called buckling or wrinkling. Said tangential forces make the stiffness of the suspension element very non-linear as sudden changes of forces occur as the diaphragm moves and the stiffness of the suspension element is not constant. In the curved sections 110 of the suspension element 100, where the radius of the suspension element is small compared with the radial width of the suspension element roll, excessive amounts of tangential forces occur, even for small displacements during small excursions. The radius of the perimeter is therefore selected to be significantly greater than the radial width of the suspension element's roll of material to avoid tangential stress problems. This is easier to achieve when the shape of the suspension element is essentially round as the radius is maximized. For other shapes, there are areas that have smaller radiuses. The areas with smaller radiuses are more susceptible to problems arising from tangential stress.

Measures are commonly used to relieve this tangential stress, including forming rolls of the suspension element material in the tangential direction. This allows the suspension element material to smoothly expand and contract in the tangential direction as the diaphragm moves without the sudden changes in forces that can occur without any tangential stress relief. Combining the invention with tangential stress relief features allows the buckling problem to be removed, further extending range of displacements where the motion is fairly linear thus allowing larger excursions without high distortion.

In order to provide tangential stress relief, the curved section 110 of the suspension element 130 may be undulated. The straight section of the suspension element does not have any such additional features that provide tangential stress relief as only the curved sections suffer from tangential stress problems. As mentioned above, the mean height of the cross-sectional profile of the curved section 110 is higher than that of the straight sections 130 of the suspension element 100. Along the length of the suspension element 100, i.e., along the circumference, the curved section 110 has a set mean height and the height undulates up and down. The magnitude of the undulations is expressed with 'A' in FIG. 4, whereas the spacing of the undulations is denoted with 'B'. The fluctuation in height A and the distance between peaks B, i.e., distance between successive peak and through points 111, 112 (FIG. 5), are design parameters for the curved shape. The undulation amplitude A reduces monotonically to zero when moving from the highest point 111 on the cross-section of the suspension element 100 down to the lowest point 112 on the transitional section 120. The lowest point of the profile is essentially flat and makes contact with the diaphragm 300.

Instead of undulations, stiffness and tangential stress of the curved section 110 may alternatively be controlled by means of ridges, grooves, different widths and material thick-nesses etc.

According to an exemplary embodiment, the following dimensions may be used for a suspension elements having material thickness of 0.5 mm; A=1.25 mm and B=5.3 mm, whereby the maximum height of the stiff straight section 130 is 5 mm and the maximum height of the less stiff curved section 110 is 10 mm. The two heights above are measured from the lowest suspension element material 112 to the highest suspension element material 111 in the areas indicated in FIG. 5.

In the given example, dimension A is quite small for preventing the peaks from becoming too tall, which would have undesirable resonances. Generally, a suitable interrelation between dimensions A and the material thickness is that A is about double the material thickness. Therefore, A is approximately twice the material thickness, whereby B is approximately 11 times the material thickness for providing suitable angles and heights for the undulations. In the given example, the relative heights of the straight and curved sections 130, 110 are 5 mm and 10 mm, respectively. Typically, the height of the suspension roll is related to the width of the suspension roll, whereby a one-to-one relationship between width and height forms a geometry that is close to a semicircular roll of material. The height of the curved sections may be extended to make the suspension rolls taller than they are wide. This lowers the stiffness of the curved sections by increasing the "free length" as explained above. A very tall suspension element with have a high amount of mass is also susceptible to resonance problems. It is therefore beneficial to keep the straight sections close to a semi-circular roll with approximately a one-to-one width to height ratio and then extend the height of the curved sections as much as possible to give the most ideal stiffness profiles.

It is proposed to select the slope of the undulations to not be very steep, for example less than 25° to the horizontal, as setting the slopes of the undulations to be too steep increases the amount of material used and therefore adds to the mass of the moving parts. However, too little slope in the undulations will limit the effect of the transitional stress relief, whereby approximately 15 to 20° to the horizontal would be a suitable average value for the slope of the undulations.

As may also be seen from FIG. 4, the transition section 120 between the straight and curved sections 110, 130, respectively, provides a gradual transition from the height of the straight section 130 to the mean height of the undulating curved section 110 occurring at the joint of the straight section 130 to the curved section 110. The length along the suspension element 100 where this height change occurs is marked with 'C' in FIG. 4. Accordingly, also the exact shape of this change profile is design parameters for the curved shape. When viewed in the axial direction, the transitional section 120 is essentially straight.

As concerns the transitional section 120, it is proposed to keep the slope not very steep as setting the slope of the transitional section to be steep increases the amount of material used and therefore adds to the mass of the moving parts. Indeed, it is proposed to lower the mass of the moving parts as this increases efficiency and boosts sensitivity. Generally speaking, a slope less than 25° to the horizontal is proposed for the transitional section 120. In the example given above, dimension C of 10.9 mm would result in a slope of approximately 25° to the horizontal. Dimension C is therefore approximately just over double the change in height between the straight and curved sections 130, 110.

Various materials may be used for constructing the suspension element 100. It is, however, proposed that a material with suitable Young's modulus is selected in order to achieve the desired amount of stiffness from the suspension element 100 together with a high loss factor, which is desirable to damp and control any unwanted resonances.

Figure 6:
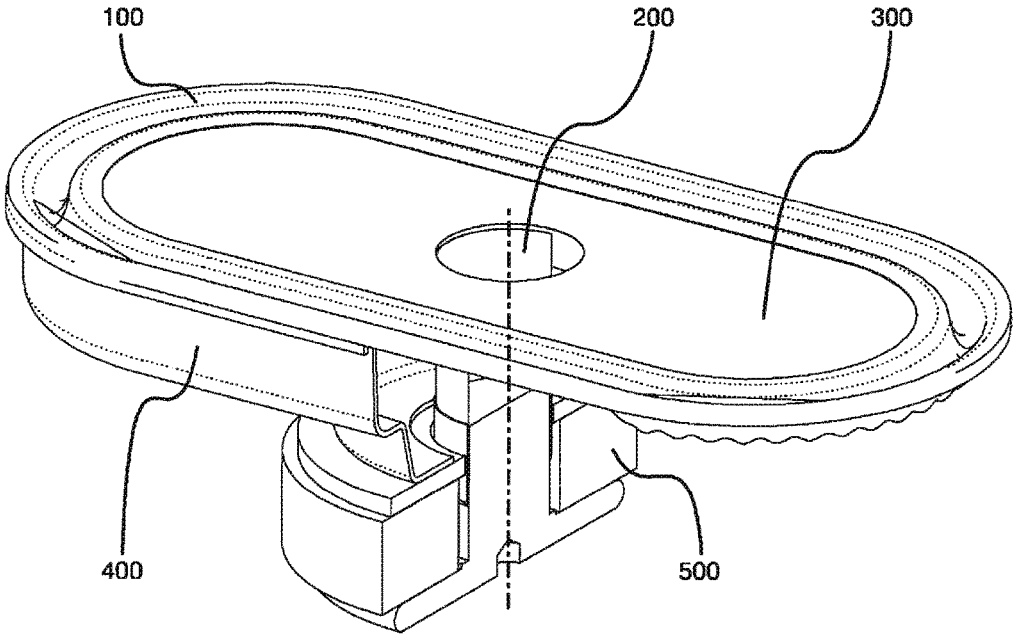
FIG. 6 presents an isometric view of the suspension element of FIG. 1 arranged to suspend a diaphragm to a chassis of a loudspeaker driver, wherein the magnetic circuit, voice coil, and chassis are illustrated as a partial cut-out view.

FIG. 6 shows the structure of a driver equipped with the suspension element 100 as shown with reference to FIGS. 1 to 5. The suspension element 100 is attached from its outside perimeter to the chassis 400 of the driver. The suspension element 100 is attached from its inner perimeter to the diaphragm 300, which is driven by the voice coil former 200 in cooperation with the magnetic circuit 500. As is apparent from FIG. 6, the suspension element 100 suspends the diaphragm 300 such that the height of the profile of the suspension element 100 extends rearward from the diaphragm. In other words, the lowest point of the cross-section suspension element 100 is more forward than the highest point of the cross-section thereof. Alternatively, the suspension element 100 may be inverted and used in an opposite orientation, if required, with the peaks pointing forwards. It is a matter of choice based on the space available in the complete loudspeaker design.

The suspension element is rigidly attached to the chassis. The suspension element is carefully attached to the diaphragm with controlled amounts of glue so as not to add too much mass to the moving parts. Reinforcement glue may be used to prevent the diaphragm 300 from peeling away from the suspension element 100. Other solutions or materials can be added to the junction between the diaphragm and suspension element to damp and control the unwanted resonances. This junction between the diaphragm and suspension element is carefully adjusted to control the standing waves and increase the highest frequency at which the driver can be used with acceptable sound quality, or reduce the audibility of the standing wave resonances if the driver is to be used at or above the standing wave resonance frequencies.

Figure 7:
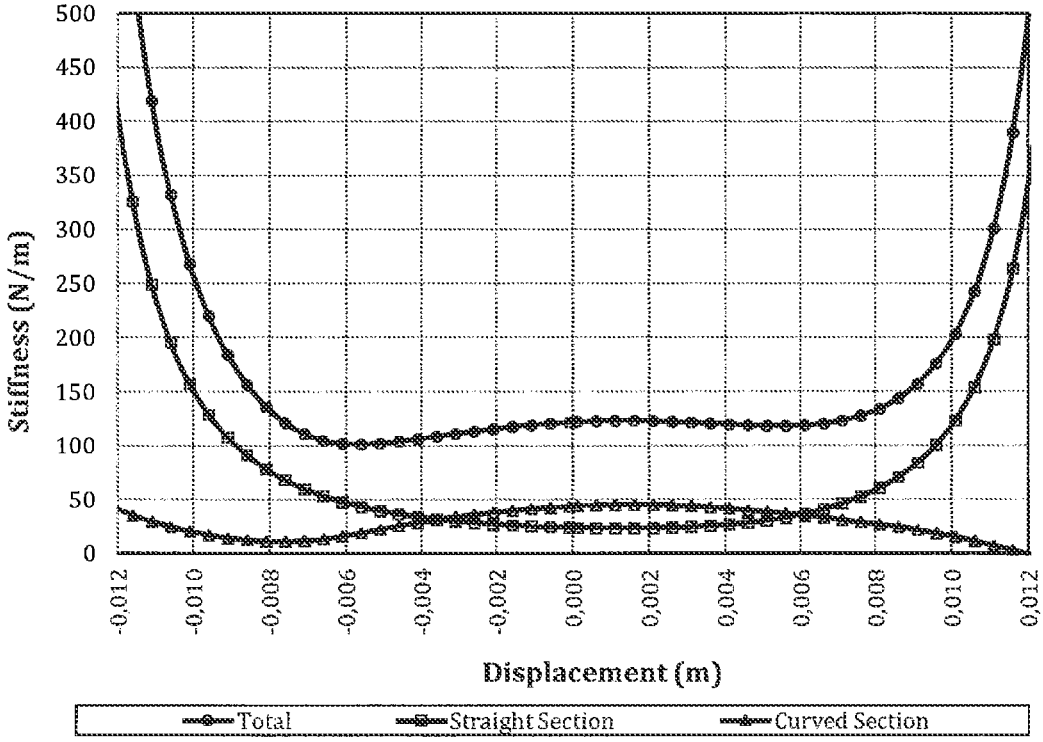
FIG. 7 presents a graph showing the symmetrical property and progressive increase of the total stiffness as a function of displacement of the suspension element of FIG. 1, namely the fairly non-linear stiffness of the curved sections and the dominant stiffness of the straight sections.
Figure 8:
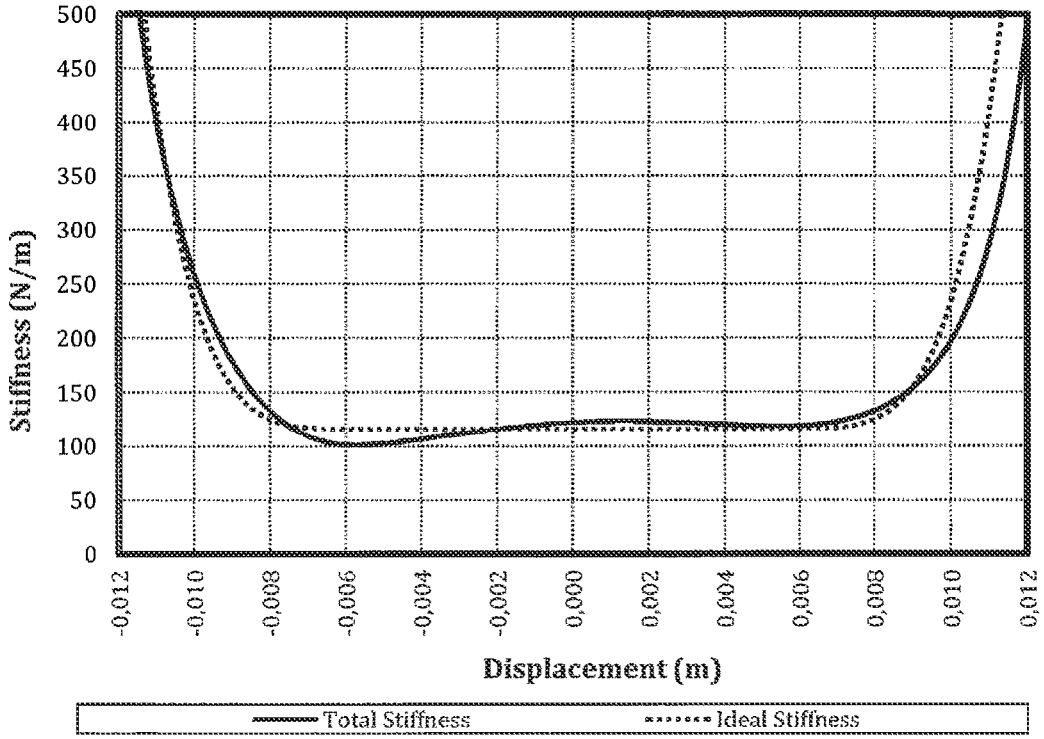
FIG. 8 presents a graph showing a comparison between the stiffness as a function of displacement of the suspension element of FIG. 1 and that of an ideal progressive suspension.

Turning now to FIGS. 7 and 8, which show the stiffness of the suspension element of FIG. 1 as well as the stiffness of an ideal suspension element. As can be seen from FIG. 7, the restoring forces are focused towards the straight sections as they have the largest stiffness and therefore the dominant forces that are flexing the diaphragm between the voice coil and the straight sections of the suspension element.

The forces and calculated stiffness profiles relating to the various sections of the suspension element 100 are obtained from finite element analysis software. The modeled total stiffness profile of the suspension element of FIG. 1 is the total combination of all of the stiffness profiles relating to the straight sections 130, transition sections 120, and also the curved sections 110. Using finite element analysis software, it is possible to separate the contribution from each section of the suspension element 100, thereby analyzing each section individually. The "straight section" stiffness profile shows the portion of stiffness related to the straight sections 130 of the suspension element 100 and the "curved section" stiffness profile shows the portion of stiffness related to the curved sections 110 of the suspension element 100.

FIG. 8 shows how the "total" stiffness profile of the suspension element of FIG. 1 compares to an "ideal" stiffness profile for a progressive suspension element. The stiffness profile for the "ideal" stiffness profile is flat in the linear range of displacements which is approximately between −0.006 and +0.006 meters. This flat line corresponds to a constant stiffness and therefore no additional distortion is added to the motion of the diaphragm and therefore to the sound output of the driver. It can also be seen how the stiffness of the "ideal" suspension element rises very sharply displacements below −0.008 and displacements above +0.008; this is desirable to protect the driver from damaging itself during very large excursions.

It can be seen that even though the curved sections 110 have a greatly increased mean height (of the radial cross-sectional profile) and therefore increased "free-length", the stiffness of the curved sections 110 is relatively high when compared to the stiffness profile of the straight sections 130. If the radial cross-sectional geometry of the curved section 110 was the same as the radial cross-sectional geometry of the straight sections 130, then the stiffness profiles of the curved section 110 would completely dominate the stiffness profiles. This is undesirable, as the stiffness profile of the curved sections 110 does not resemble the "ideal" stiffness profile (as seen in FIG. 8) that is desired for a low distortion progressive suspension element. For this reason, it is necessary to diminish the contribution from the undesirable curved sections 110 so that the more ideal contribution from the straight sections 130 dominates the overall total stiffness profile for the entire suspension element 100.

It can be seen that the "straight section" stiffness profile (as seen in FIG. 7) has some resemblance to the "ideal" stiffness profile of a progressive suspension element in FIG. 8. In the linear displacement range which is approximately between −0.006 and +0.006 the stiff-ness varies by approximately 50%. The "straight section" stiffness profile rises very sharply for displacements below −0.008 and displacements above +0.008; this is desirable to protect the driver from damaging itself during very large excursions.

It can be seen that the "curved section" stiffness profile (as seen in FIG. 7) does not have any resemblance to the "ideal" stiffness profile of a progressive suspension element in FIG. 8. In the linear displacement range which is approximately between −0.006 and +0.006 the stiffness varies by approximately 65%, this is more non-linear than the straight sections' stiffness profile. The "curved section" stiffness profile does not rise at all for displacements below −0.008 and displacements above +0.008; this prevents the progressive behavior from functioning and disables the protection that prevents the driver from damaging itself during very large excursions.

It can be seen that the "total" stiffness profile has a very close resemblance to the "ideal" stiffness profile of a progressive suspension element in FIG. 8. In the linear displacement range that is approximately between −0.006 and +0.006, the stiffness varies by approximately 17%, which is much more linear than the individual "straight section" and "curved section" stiffness profiles. The "total" stiffness profile rises very sharply for displacements below −0.008 and displacements above +0.008; this is desirable to protect the driver from damaging itself during very large excursions.

Figure 9:
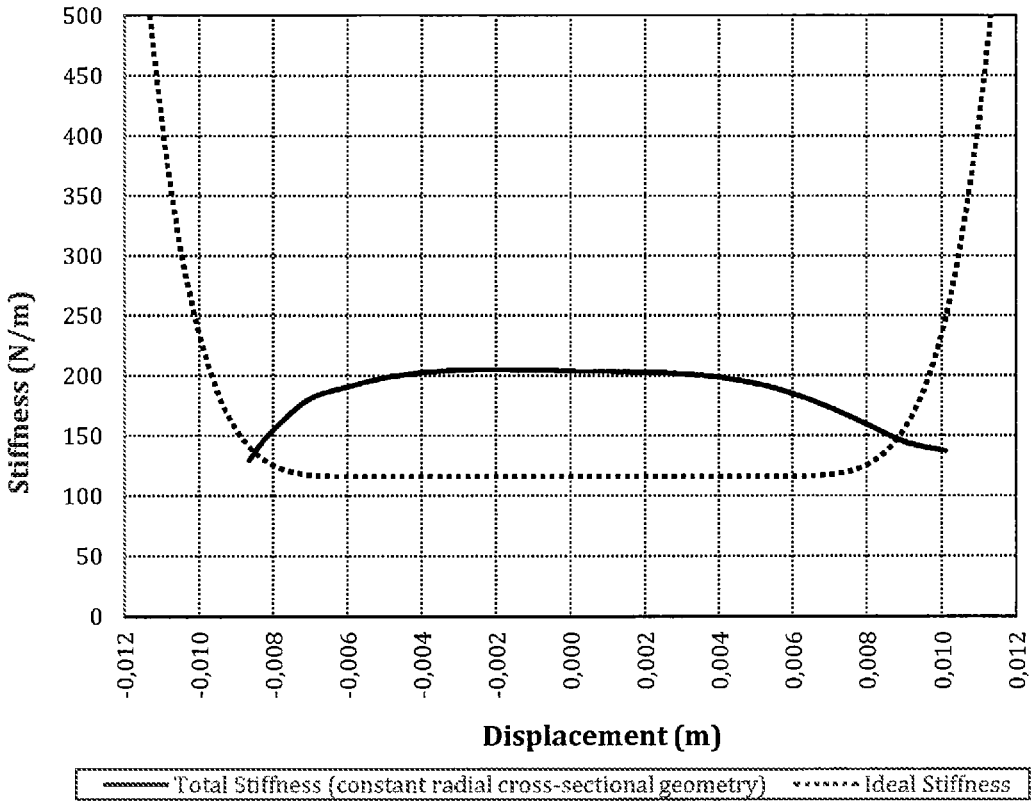
FIG. 9 presents a graph showing a stiffness profile of a suspension element with a constant radial cross-sectional geometry.

Turning now to FIG. 9, which shows the stiffness profile of a suspension element that has a constant radial cross-sectional geometry. This type of suspension element has the same height cross-sectional geometry on the straight sections and also on the curved sections. There are no undulations that are used to relieve that tangential stress. As can be seen from FIG. 9, the progressive nature of the suspension element has been lost. In the linear dis-placement range which is approximately between −0.006 and +0.006, the stiffness varies by approximately 10%, which is very linear indeed.

The "constant radial cross-sectional geometry" stiffness profile does not increase at all for displacements below −0.008 and displacements above +0.008, therefore the progressive nature of the suspension element is desirable to protect the driver from damaging itself during very large excursions has been lost.

The magnitude of the stiffness of the constant radial cross-sectional geometry is much higher than the ideal stiffness. It is foreseen to have a low stiffness, i.e., a more compliant design, for the suspension element. The low stiffness design is proposed to achieve a low driver free air resonance with a low moving mass.

The terms and expressions that have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A suspension element for suspending the diaphragm of a loudspeaker driver to a chassis thereof, the suspension element having a geometry comprising two opposing first sections and two opposing curved second sections connecting the first sections for matching to the geometry of the diaphragm, wherein the curved second sections have a curvature radius smaller than that of the first sections, wherein:

a mean height of a radial cross-sectional profile of the curved second section is higher than a height of a cross-sectional profile of the first sections, and in that the first sections have an axial stiffness greater than that of the curved second sections.

2. The suspension element according to claim 1, wherein the curved second section comprises deviations in the height of the radial circumferential cross-section of the suspension element.

3. The suspension element according to claim 2, wherein the curved second sections are equipped with formations providing tangential stress relief.

4. The suspension element according to claim 2, wherein the curved second sections of the suspension element are axially undulated along said sections.

5. The suspension element according to claim 2, wherein the mean height of the radial cross-sectional profile of the curved second section is at least twice as high as the height of the cross-sectional profile of the first section.

6. The suspension element according to claim 2, wherein the first section is connected to the curved second section via a straight transition section, the height of which increases from the height of the first section to at least the through height of the curved second section.

7. The suspension element according to claim 1, wherein the curved second sections are equipped with formations providing tangential stress relief.

8. The suspension element according to claim 7, wherein the formations providing tangential stress relief comprise ridges, grooves or variable widths or material thickness.

9. The suspension element according to claim 1, wherein the curved second sections of the suspension element are axially undulated along said sections.

10. The suspension element according to claim 9, wherein the suspension element has a material thickness, whereby the undulation amplitude between a through and peak height is approximately double the material thickness.

11. The suspension element according to claim 9, wherein the slope of the undulations of the curved second section is less than 25° to the horizontal.

12. The suspension element according to claim 1, wherein the mean height of the radial cross-sectional profile of the curved second section is at least twice as high as the height of the cross-sectional profile of the first section.

13. The suspension element according to claim 1, wherein the first section is connected to the curved second section via a straight transition section, the height of which increases from the height of the first section to at least the through height of the curved second section.

14. The suspension element according to claim 13, wherein the undulation amplitude of the curved second section is reduced monotonically to zero by the transition section when examined from the highest point on the cross-section of the curved second section.

15. The suspension element according to claim 13, wherein the first section and the transitional section are essentially straight when viewed in the axial direction.

16. The suspension element according to claim 13, wherein the slope of the undulations of the curved second section is less than 25° to the horizontal.

17. The suspension element according to claim 1, wherein suspension element is configured to suspend a diaphragm of a loudspeaker driver to the chassis thereof.

18. A loudspeaker driver comprising:

a chassis, a diaphragm, and a suspension element configured to suspend the diaphragm to the chassis axially, in which the suspension element has a geometry comprising two opposing first sections and two opposing curved second sections connecting the first sections for matching to the geometry of the diaphragm, wherein the curved second sections have a curvature radius smaller than that of the first sections, wherein:

a mean height of a radial cross-sectional profile of the curved second section is higher than a height of a cross-sectional profile of the first sections, and in that the first sections have an axial stiffness greater than the curved second sections.

19. The loudspeaker driver according to claim 18, wherein the suspension element suspends the diaphragm such that the height of the profile of the suspension element extends rearward from the diaphragm.

20. A loudspeaker comprising a loudspeaker driver comprising:

a chassis, a diaphragm, and a suspension element, configured to suspend the diaphragm to the chassis axially, which the suspension element has a geometry comprising two opposing first sections and two opposing curved second sections connecting the first sections for matching to the geometry of the diaphragm, wherein the curved second sections have a curvature radius smaller than that of the first sections, wherein:

a mean height of a radial cross-sectional profile of the curved second section is higher than a height of a cross-sectional profile of the first sections), and in that the first sections have an axial stiffness greater than the curved second sections.

* * * * *